US005513423A

United States Patent [19]

Jakob et al.

[11] Patent Number: 5,513,423

[45] Date of Patent: May 7, 1996

[54] APPARATUS FOR NEEDLING A CIRCULAR NONWOVEN WEB

[75] Inventors: Heinrich Jakob, Linz; Hannes Pum, Alberndorf, both of Austria

[73] Assignee: Textilmaschinenfabrik Dr. Ernst Fehrer Aktiengesellschaft, Leonding, Austria

[21] Appl. No.: 423,882

[22] Filed: Apr. 18, 1995

[30] Foreign Application Priority Data

May 2, 1994 [AT] Austria ..... 914/94

[51] Int. Cl.[6] ..... D04H 18/00; D04H 3/10

[52] U.S. Cl. ..... 28/107; 28/114

[58] Field of Search ..... 28/107, 109, 110, 28/111, 113, 114

[56] References Cited

U.S. PATENT DOCUMENTS 5,153,970 10/1992 König ..... 28/107
5,323,523 6/1994 Lawton et al. ..... 28/107 X
5,388,320 2/1995 Smith et al. ..... 28/107 X

FOREIGN PATENT DOCUMENTS 424988 5/1991 European Pat. Off. .
232059 11/1991 European Pat. Off. .
2626294 7/1989 France ..... 28/107

*Primary Examiner*—John J. Calvert
*Attorney, Agent, or Firm*—Collard & Roe

[57] ABSTRACT

The described apparatus for needling a circular nonwoven web, particularly a nonwoven web having the configuration of a circular ring, comprises a needle board, which carries a multiplicity of needles and is adapted to be driven to reciprocate said needles in a predetermined piercing direction. The apparatus also comprises a turntable (1), which comprises a web support that is adapted to support the nonwoven web. The needle board is provided with needles only in at least one sector-shaped region, which has the configuration of a sector with respect to the axis of rotation of the turntable.

4 Claims, 3 Drawing Sheets

9
8
10
4
14
14
13
13
5
6
7
2
II
3
12
II
11
1

APPARATUS FOR NEEDLING A CIRCULAR NONWOVEN WEB

BACKGROUND OF THE INVENTION

1. Field of the Invention

This invention relates to an apparatus for needling a circular nonwoven web, which has preferably the configuration of s circular ring, comprising a needle board, which carries a multiplicity of needles and is adapted to be driven to reciprocate said needles in a piercing direction, and a turntable, which is operable to rotate about an axis of rotation and comprises a web support for supporting said nonwoven web in such a position that said needles are adapted to pierce said nonwoven web supported by said web support.

2. Background of the Invention

It is known (from EP-B1-0,232,059) that a nonwoven web comprising one or more plies and having the configuration of a circular ring can be needled in that the nonwoven web is moved on a turntable past needling means, which have a working width that is adapted to the width of the annular nonwoven web. Because the turntable in the region in which it is contacted by the annular nonwoven web constitutes a continuous support for the nonwoven web to be pierced and for that purpose is made, e.g., of a foamed plastic, it is possible to needle the nonwoven web also during a plurality of revolutions. But a disadvantage of such needling means resides in that the nonwoven web is not uniformly needled over its width because the nonwoven web is moved on a circular path and the needles are uniformly distributed over the needle board in the usual manner. In that connection it must be borne in mind that the circumferential velocity of the annular nonwoven web is higher near its outer radius than near its inner radius so that the piercing density will be lower in the outer portion of the annular nonwoven web than in its inner portion, i.e., the needling density will not be uniform over the width of the annular nonwoven web, if the needles are uniformly distributed over the surface of the needle board, which extends radially with respect to the axis of the turntable.

SUMMARY OF THE INVENTION

For this reason it is an object of the invention to provide for the needling of a circular nonwoven web, particularly of a nonwoven web having the configuration of a circular ring, an apparatus which is of the kind described first hereinbefore and which with use of simple means is so designed that a uniform needling density over the width of the annular nonwoven web can be achieved in spite of the fact that the nonwoven web is moved on a circular path past the needling means.

The object set forth is accomplished in accordance with the invention in that the needles are provided on the needle board only in at least one sector-shaped region which has the configuration of a sector with respect to the axis of rotation of the turntable.

Because the needles are provided only in a region which has the configuration of a sector with respect to the axis of rotation of the turntable the number of needles in the direction of movement of the nonwoven web decreases from the outer portion to the inner portion in proportion to the radius so that the change of the piercing density, which is inversely proportional to the circumferential velocity and also to the radius, is just compensated and, as a result, a uniform needling density can be ensured throughout the radial extent of the circular nonwoven web whereas it is not necessary to change the density of the needles within that portion of the board which is provided with needles. Because said distribution of the needles can hardly be achieved adjacent to the axis of rotation of the turntable as the distances between the needles are determined by structural considerations, a perfect compensation cannot be expected adjacent to the axis of rotation of the turntable and for this reason the best results will be produced only if the nonwoven web is annular.

A particularly desirable design will be achieved if the needle board is provided with needles only in two sector-shaped regions, which are symmetrical to a plane which contains the axis of rotation the turntable. In that case the needling effect can be doubled and the board may be relatively simple if the substantially rectangular needle board extends transversely to the axial plane of symmetry. In such an arrangement it will be desirable to minimize the width of the needle board in the direction of movement of the nonwoven web and, as a result, to minimize also the mass which is to be moved. For that purpose it is recommendable to define the two sector-shaped regions of the needle board on one of the side edges of the board by a common plane which includes a diameter of the turntable and extends along the one of the side edges of the board. Whereas this will result in an unsymmetrical distribution of the needles with respect to the center plane of the needle board, which plane extends substantially in the direction of the working width, any tilting moments which in that case may be exerted on the needle board may readily be compensated in that the board is supported by means which have a corresponding eccentricity.

DETAILED DESCRIPTION 0F THE PREFERRED EMBODIMENT

Figure 1:
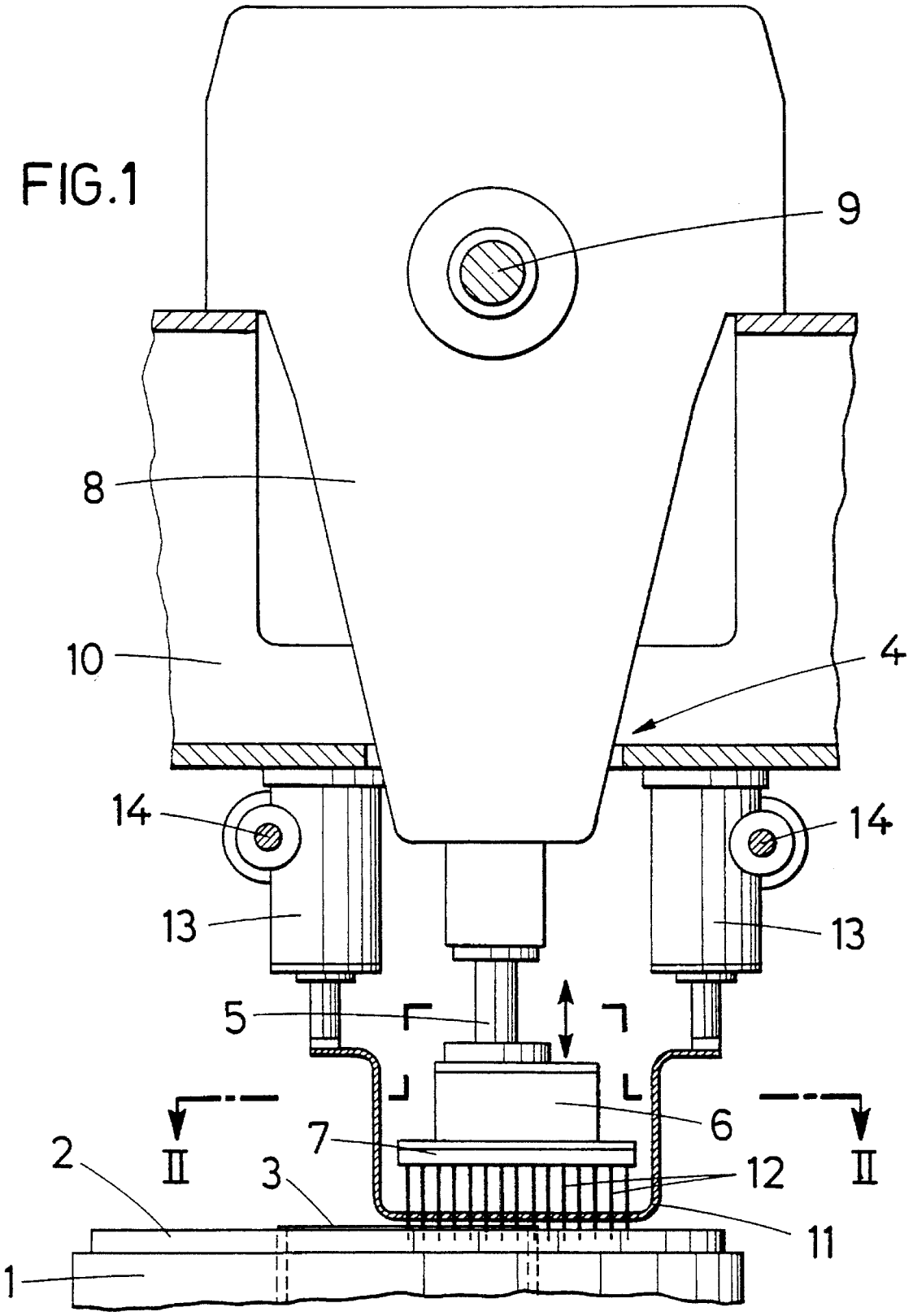
FIG. 1 is a schematic side elevation, which is partly torn open and shows an apparatus according to the invention for needling a nonwoven web having the configuration of a circular ring.

The subject matter of the invention will now be described more in detail with reference to the drawing.

The illustrated apparatus for needling an annular needle board substantially consists of a turntable 1, which constitutes a support 2 for the nonwoven web and for guiding the annular nonwoven web comprises a guide cylinder 3, which protrudes above the web support 2. In association with said turntable 1 the apparatus comprises needling means 4, which are generally designed as usual and comprises a needle beam 6, which is secured to push rods 5 and to which a needle board 7 is detachably secured. The needle beam 6 is driven via the push rods 5 by an eccentric drive, which is mounted in a housing 8 and comprises a drive shaft 9. The housing 8 is carried by a frame 10, from which a vertically adjustable stripper 11 for cooperating with the needles 12 of the needle board 7 is suspended so that the gap provided for the nonwoven web between the stripper 11 and the web support 2 can be adapted to the thickness of the nonwoven web. The stripper 11 is adjustable by screw drives 13, which can be adjusted by actuating shafts 14, which can be turned by hand.

Figure 2:
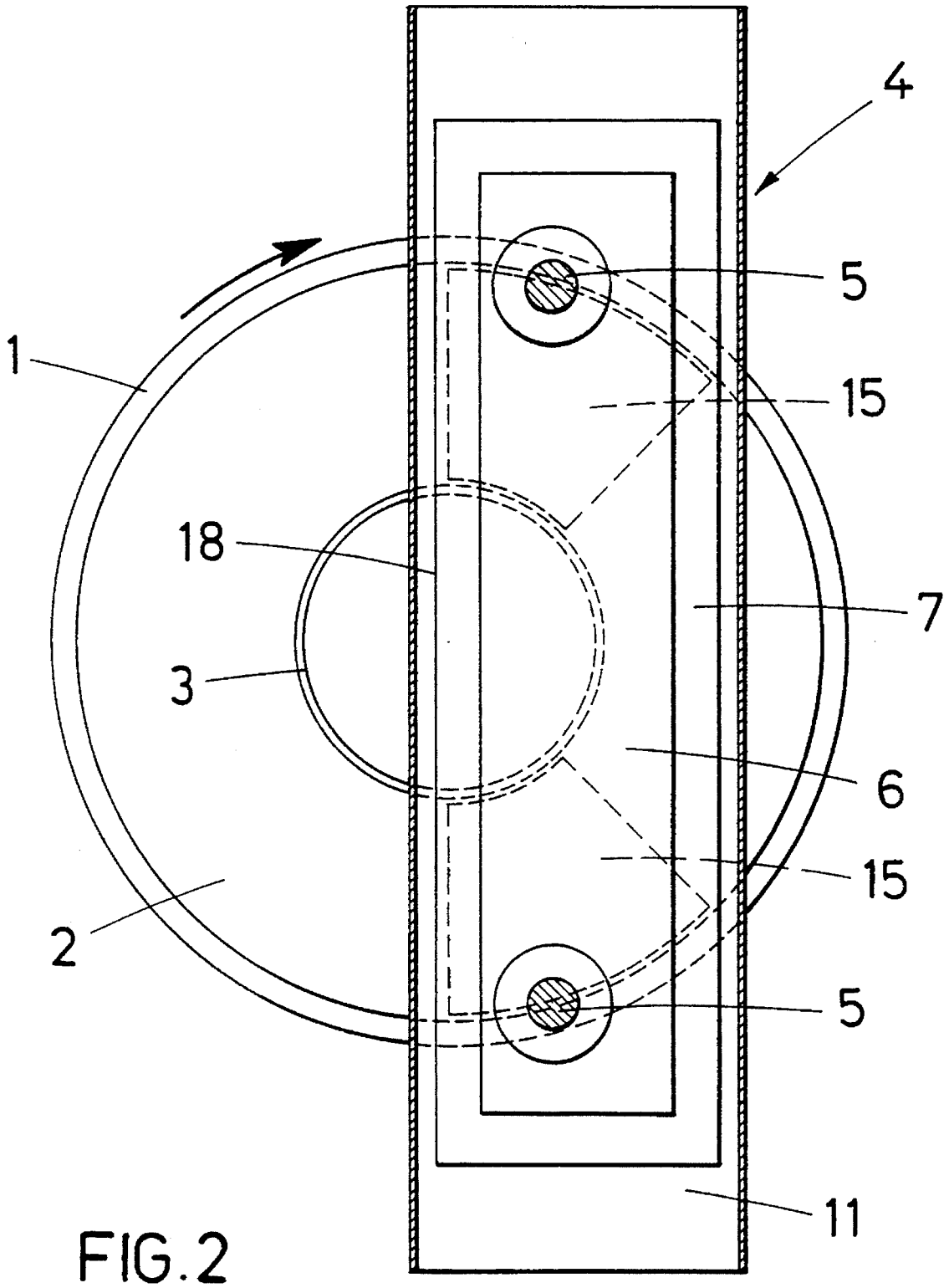
FIG. 2 is a sectional view taken on line II—II in FIG. 1 and showing that apparatus.
Figure 3:
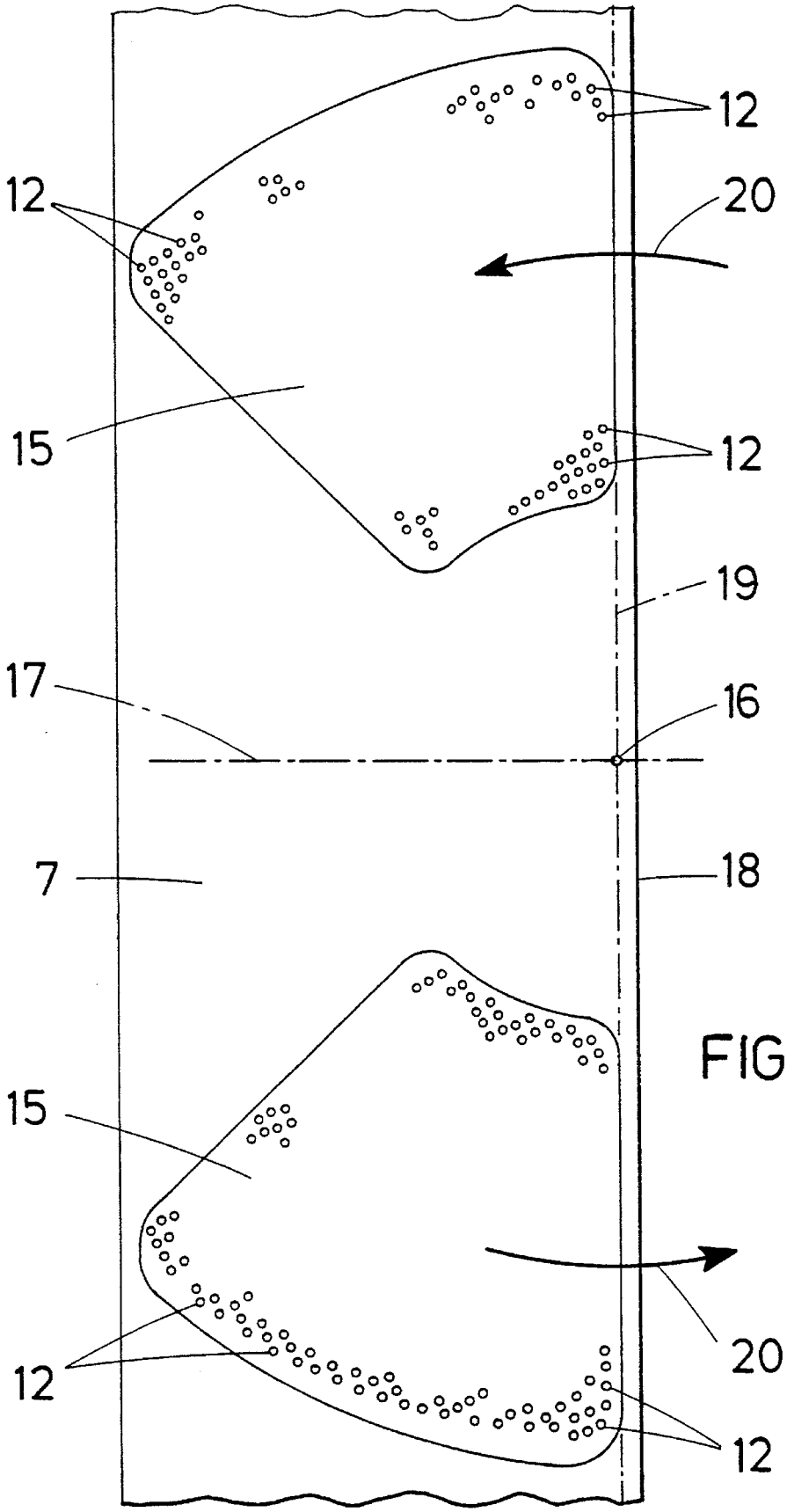
FIG. 3 shows on a larger scale a fragmentary view of the needle board.

A difference from conventional needling means resides in that the needles 12 are not uniformly distributed over the needle board 7 but are provided only in sector-shaped regions 15, which have the configuration of sectors with respect to the geometric axis of rotation 16 of the turntable 1. This is illustrated in FIG. 3. The arrangement is such that the two sector-shaped regions 15 which are provided with the needles 12 are symmetrical with respect to an axial plane 17, which is at right angles to the longitudinal direction of the needle board 7, and said regions are defined along one longitudinal side edge 18 of the board by a diametrical plane 19 of the turntable 1, which diametral plane extends along that side edge 18 of the board. As s result, the board has a small width. But such an arrangement of the sector-shaped regions 15 involves an unsymmetrical arrangement of the needles with respect a center plane of the board, which center plane extends in the longitudinal direction of the board, as is directly apparent from FIG. 3. To avoid an exertion of tilting moments on the needle board 7 owing to said unsymmetry, the push rods 5 engage the needle beam 6 at eccentric locations, as is shown in FIGS. 1 and 2.

The holes in which the needles 12 move through the stripper 17 may also be restricted to sector-shaped regions corresponding to the arrangement of needles in the needle board 7.

Because the needles are provided only in regions 15 which have the configuration of sectors 15 with respect to the axis of rotation of the turntable 1 and are uniformly distributed in each of said regions 15, it is possible to ensure that the nonwoven web will uniformly be needled over the width of the ring in the zones determined by the sector-shaped regions in spite of the fact that the nonwoven web moves on an arcuate path 20 through the needling zones which are determined by the sector-shaped regions 15. This result is produced because the number of needles 12 in the direction of movement 20 of the nonwoven web decreases with the radius from the area near the outer radius toward the inner radius of the nonwoven web. Because a decreasing speed of the nonwoven web during the reciprocation of the needle board 7 at a constant frequency will result in an increase of the piercing density and the needling density, the dependence of the needling density on the speed of movement of the nonwoven web, which speed of movement decreased toward the inside periphery of the annular nonwoven web, can be compensated by the fact that the number of needles in the direction of movement of the nonwoven web decreases toward the latter area and that the piercing density is also determined by that number of needles.

It will be understood that the invention is not restricted to the embodiment illustrated by way of example. For instance, needles could be provided only in one sector-shaped region or, under certain circumstances, in more than two sectors rather than in the two sector-shaped regions 15. The nonwoven web may inherently consist of a ring or may be formed during the needling operation from a web which has the shape of an arc of a circle and which is fed to the turntable. The web support may consist of foamed material. But the needling conditions will be particularly favorable if the web support consists of a brush.

We claim:

1. In an apparatus for needling a circular nonwoven web, which apparatus comprises a needle board, which carries a multiplicity of needles and is adapted to be driven to reciprocate said needles in a predetermined piercing direction and a turntable, which is operable to rotate about an axis of rotation and comprises a web support for supporting said nonwoven web in such a position that said needles are adapted to pierce said nonwoven web supported by said web support, the improvement residing in that said needle board is provided with uniformly distributed needles only in at least one sector-shaped region that has the configuration of a sector defined by two radial lines passing through said axis of rotation.

2. The improvement set forth in claim 1, as applied to an apparatus for needling a nonwoven web having the configuration of a circular ring.

3. The improvement set forth in claim 1, wherein said needle board is provided with needles only in two of said sector-shaped regions, which are symmetrical with respect to a plane which contains said axis of rotation of said turntable.

4. The improvement set forth in claim wherein said needle board has substantially the configuration of a rectangle having two mutually opposite side edges and said two sector-shaped regions are defined near one of said side edges by a common plane, which contains a diameter of said turntable and extends near said one side edge along the same.

* * * * *